US012392569B2

(12) United States Patent
Irons

(10) Patent No.: US 12,392,569 B2
(45) Date of Patent: Aug. 19, 2025

(54) BOLT RETENTION SYSTEM

(71) Applicant: Trenton Irons, Santa Clarita, CA (US)

(72) Inventor: Trenton Irons, Santa Clarita, CA (US)

( * ) Notice: Subject to any disclaimer, the term of this patent is extended or adjusted under 35 U.S.C. 154(b) by 0 days.

(21) Appl. No.: 18/732,681

(22) Filed: Jun. 4, 2024

(65) Prior Publication Data

US 2024/0361091 A1 Oct. 31, 2024

Related U.S. Application Data

(63) Continuation of application No. 17/454,097, filed on Nov. 9, 2021, now abandoned.

(60) Provisional application No. 63/124,275, filed on Dec. 11, 2020.

(51) Int. Cl.
*F41A 3/42* (2006.01)

(52) U.S. Cl.
CPC ..... *F41A 3/42* (2013.01)

(58) Field of Classification Search
CPC ..... F41A 3/42
See application file for complete search history.

(56) References Cited

U.S. PATENT DOCUMENTS

| | | | | |
|---|---|---|---|---|
| 10,753,696 | B1 * | 8/2020 | Christopher | F41A 17/42 |
| 2019/0137202 | A1 * | 5/2019 | Facchini | F41A 3/72 |
| 2020/0096267 | A1 * | 3/2020 | Horst | F41A 3/42 |

* cited by examiner

*Primary Examiner* — Michelle Clement
(74) *Attorney, Agent, or Firm* — Bennet K. Langlotz; Langlotz Patent & Trademark Works, LLC

(57) ABSTRACT

A firearm comprises a frame having a barrel and defining a passage registered with the barrel, with a bolt configured to reciprocate in the passage between a forward battery condition and a retracted condition. A latch that is movable between a retention position in which the bolt is prevented by the latch from moving from the retracted position to the battery position, and a release condition in which the bolt is prevented by the latch from moving from the retracted position to the battery position. The latch is biased to the retention position such that the bolt is retained in the retracted position after every shot; and an actuator connected to the latch and configured to move the latch to the release condition.

12 Claims, 17 Drawing Sheets

Fig. 1.5
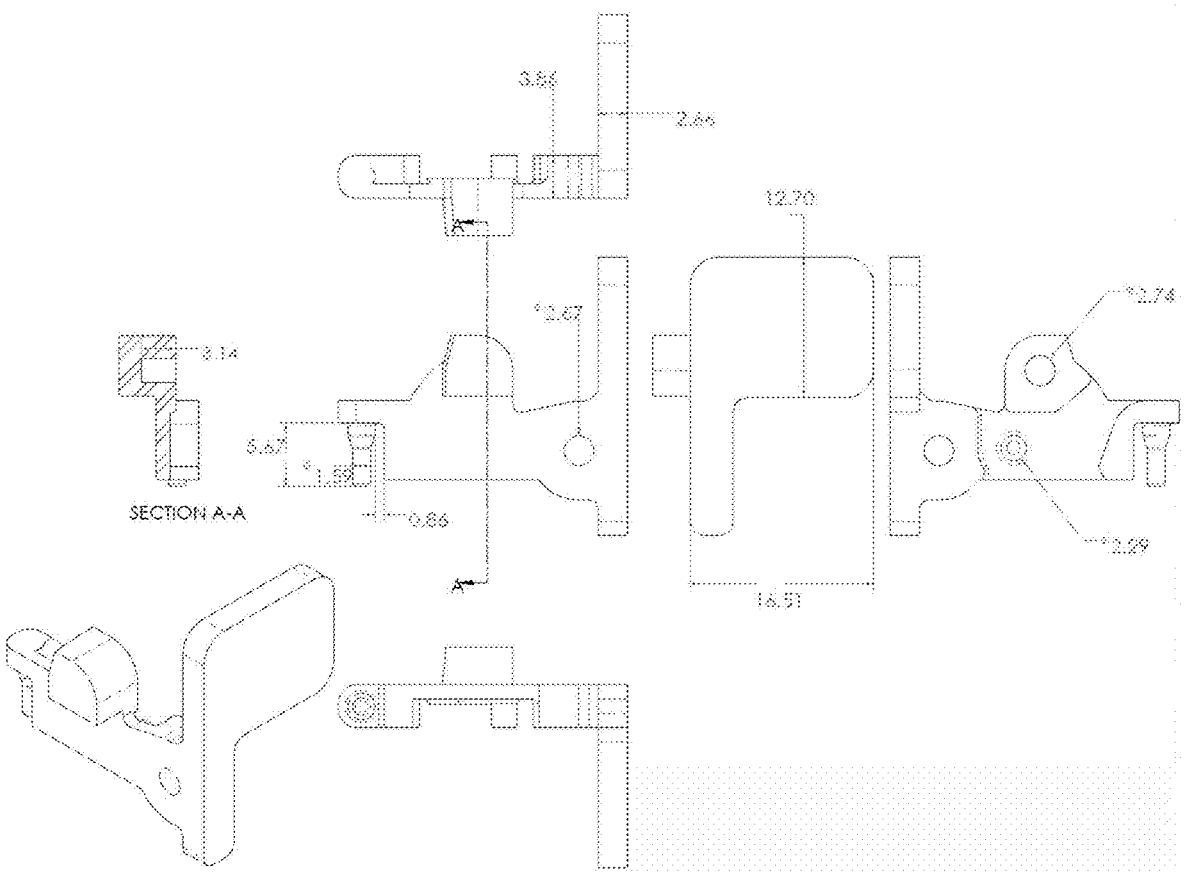

SPRING SPECIFICATIONS 0.25" LENGTH
OD: 0.088
ID: 0.068
WIRE DIAMTER 0.01" RATE: 4.33 LBS/IN
MATERIAL 316 STAINLESS

Fig. 4
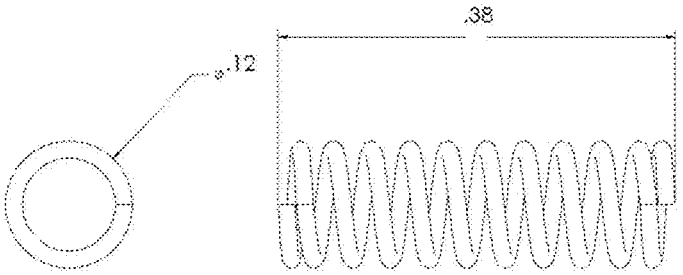
SPRING PROPERTIES
FREE LENGTH: 0.375"
OD: 0.12"
ID: 0.088"
WIRE DIAMETER: 0.016
RATE: 9.71 LBS/IN
MCMASTER CARR PN: 1986K41
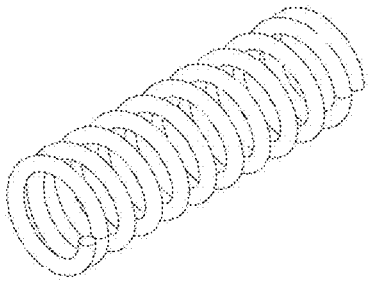

Fig. 5
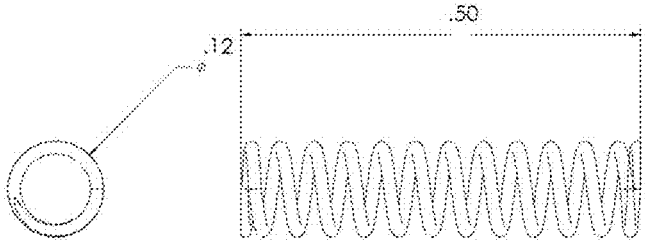
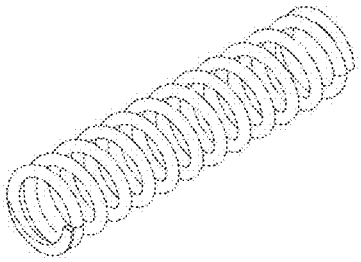
FREE LENGTH: 0.5"
OD: 0.12"
ID: 0.088"
WIRE DIAMETER: 0.016" COMPRESSED LENGTH: 0.28"
RATE: 8.5 LBS/IN MCMSTERCARR PN: 9434K13

Figure 7 – Position 1

Figure 8 – Position 2

Figure 9 – Position 3

BOLT RETENTION SYSTEM

CROSS-REFERENCE TO RELATED APPLICATIONS

This application claims the benefit of U.S. Non-Provisional patent application Ser. No. 17/454,097, filed Nov. 9, 2021, entitled "BOLT RETENTION SYSTEM", which claims benefit to Provisional Patent Application No. 63/124,275, filed on Dec. 11, 2020, entitled "BOLT RETENTION SYSTEM", which are hereby incorporated by reference in its entirety for all that is taught and disclosed therein.

FIELD OF THE INVENTION

The present invention relates to modern sporting rifles.

BACKGROUND AND SUMMARY

The modern sporting rifle is one of the most popular firearms being sold today. It is a very flexible platform that has applications such as hunting, self-defense, competition shooting, and more.

The modern sporting rifle is also heavily regulated by many federal and state governments. In its standard configuration, many state governments refer to it as an "assault weapon", which is a designation that prevents purchase, sale, or transfer in applicable states.

A firearm comprises a frame having a barrel and defining a passage registered with the barrel, with a bolt configured to reciprocate in the passage between a forward battery condition and a retracted condition. A latch that is movable between a retention position in which the bolt is prevented by the latch from moving from the retracted position to the battery position, and a release condition in which the bolt is prevented by the latch from moving from the retracted position to the battery position. The latch is biased to the retention position such that the bolt is retained in the retracted position after every shot; and an actuator connected to the latch and configured to move the latch to the release condition.

The Lever (FIG. 1, FIG. 1.5) has a hole where the standard bolt catch roll pin can be placed to secure the BRS to the firearm.

The Lever (FIG. 1, FIG. 1.5) has an arm that extends down towards the trigger well at an angle that puts it in position to be used by a right-handed shooter's trigger hand. The angle of the arm is also crucial as it prevents negligible discharges by being a small distance away from the trigger.

The Lever (FIG. 1, FIG. 1.5) has a spring post upon which the Lever Spring (FIG. 4) is attached.

Figure 1:
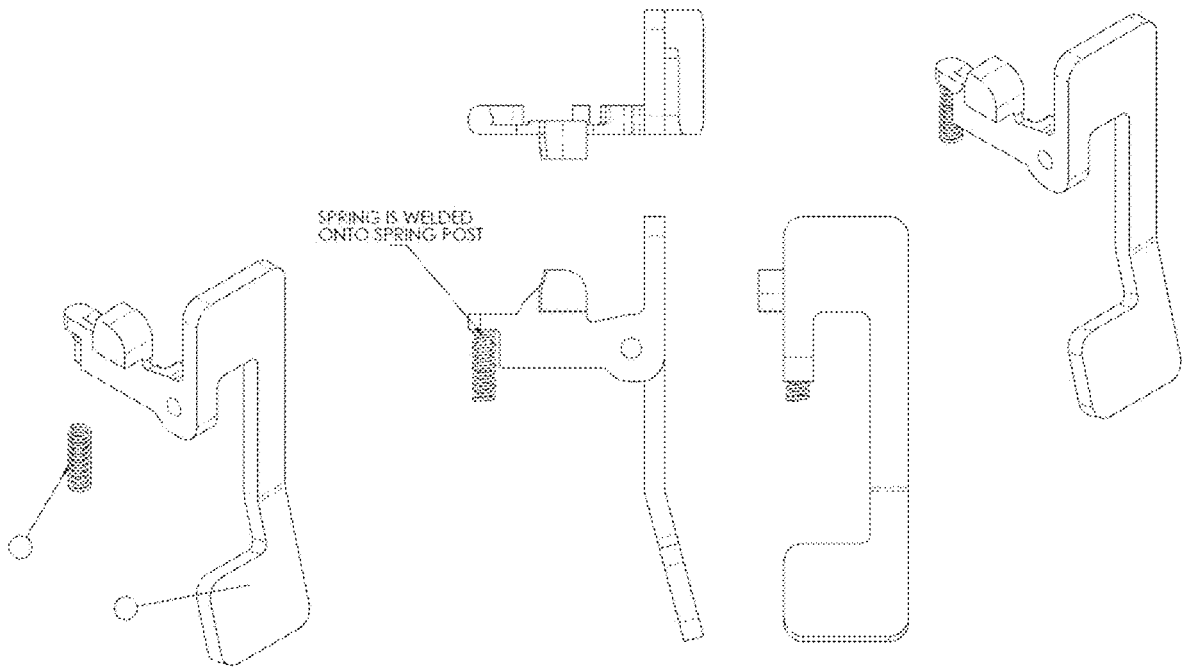
FIGS. 1 and 1.5 show the Lever in two levels of detail. The Lever (FIG. 1, FIG. 1.5) is one of two pivotal bodies that makes up the BRS. It can be made from a steel carbon alloy and should be heat treated such that it can withstand an indefinite amount of impact from the bolt. The most efficient way to manufacture the Lever (FIG. 1, FIG. 1.5) is through investment casting and post-process machining.

The Lever (FIG. 1, FIG. 1.5) has a semi-circle spring housing where the Biasing Spring (FIG. 3) is housed that biases the Tab (FIG. 2) away from the Lever (FIG. 1, FIG. 1.5).

The Lever (FIG. 1, FIG. 1.5) has a small post in the center of the piece that is used to permanently affix the Tab (FIG. 2) to the Lever (FIG. 1, FIG. 1.5). During assembly, the Tab (FIG. 2) is placed onto the pivot post, and the pivot post is flared out using a punch. The pivot post on the Lever (FIG. 1, FIG. 1.5) allows the Tab (FIG. 2) to rotate and tilt forward and backward. The rotation and tilting of the Tab (FIG. 2) is limited by the geometry of the Lever (FIG. 1, FIG. 1.5).

Figure 2:
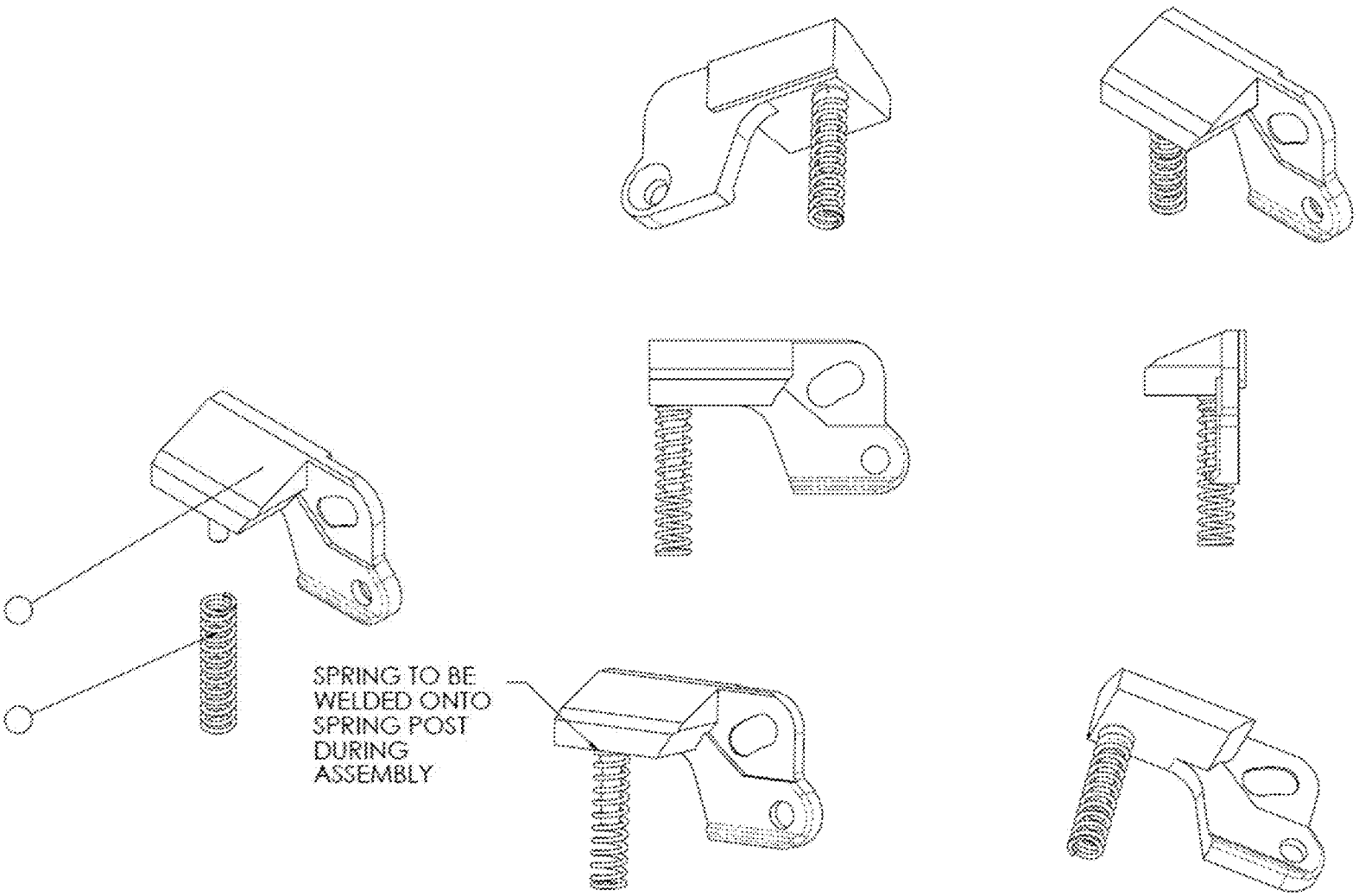

The Lever (FIG. 1, FIG. 1.5) has a small ledge that is companion to a ledge on the Tab (FIG. 2). The ledge interacts with the ledge on the Tab (FIG. 2), and allows the user to interact with the arm on the Lever (FIG. 1, FIG. 1.5) to push the BRS downward and release the bolt and chamber the next round. This ledge is crucial to the disconnect functionality. More detail on this ledge and the disconnect functionality will be added during the explanation of the Tab (FIG. 2).

The lever has two positions and ranges of motion. It tilts upward and downward on the axis of the bolt catch roll pin. It's rotation is limited by the geometry of the lower receiver of the firearm it is installed in, and the geometry of the Tab (FIG. 2).

The arm of the lever consists of two symmetrical rounded squares with a solid angled arm connecting the two. This is to allow the user to interface with the Lever at the point of the bolt catch port, as well as with the trigger finger at the bottom end of the arm. However, the arm of the lever could also be:

- Lacking a square at the top and with a triangular, hexagonal, or circular interface at the bottom;
- Rather than a solid rectangular arm, the arm could be ported;
- FIG. 2 shows the Tab. The Tab (FIG. 2) is one of two pivotal bodies that makes up the BRS. It can be made from a steel carbon alloy and should be heat treated such that it can withstand an indefinite amount of impact from the bolt, but should be flexible enough that it does not shatter or cause damage to the face of the bolt. The most efficient way to manufacture the Tab (FIG. 2) is through investment casting and post-process machining.

The Tab (FIG. 2) has a hole with a gradual opening on one side. This hole accommodates the pivot post from the Lever (FIG. 1, FIG. 1.5). The gradual opening allows for the pivot post on the Lever (FIG. 1, FIG. 1.5) to flare outwards. The geometry of this gradual opening limits the forward and backward tilting of the Tab (FIG. 2). By design, there is a small amount of space between the flared pivot post from the lever and the gradual opening on the Tab. This freedom allows for the rotation and tilting.

The Tab (FIG. 2) has a small ledge beneath the aforementioned hole that acts against the Lever (FIG. 1, FIG. 1.5) when the Lever is in its downward most position and when the Tab is in its upward most position. This ledge tilts the top end of the tab towards the Lever and the bottom end of the tab away from the lever, creating a frictional force that keeps the Lever down when the user has attempted to defeat the BRS.

The Tab has a spring post upon which the Tab Spring (FIG. 5) is affixed.

The Tab has a small ledge which is companion to the ledge on the lever. These two ledges act upon one another during normal operation to allow the tab and the lever to move in unison. When a user attempts to defeat the BRS by holding down on the arm on the Lever (FIG. 1, FIG. 1.5), these two ledges separate, and the frictional force caused by the tilting of the tab keeps the Lever ledge from re-engaging with the Tab ledge. Because the ledges must be in contact for the user to be able to release the bolt, the firing cycle is paused until the user releases the pressure from the bolt which releases the frictional force keeping the lever down and the ledges from interacting. Once force has been released, the Lever rises up, the companion ledges mate, and the user can interact with the arm on the Lever to release the bolt.

The Tab also has a small indent where the Biasing Spring (FIG. 4) that is housed within the Lever comes into contact with the Tab.

The Tab has two positions and ranges of motion. It tilts upward and downward on the axis of the pivot post on the Lever. Its rotation is limited by the geometry of the Biasing Spring Housing on the Lever and the Pivot Post.

In order to combat wear and tear, the Tab could also have a metal additive braised onto the top of the piece where impact is expected. This braised piece could be a softer steel alloy that could act as a protective barrier such that the Tab does not get damaged over long periods of time.

Figure 3:
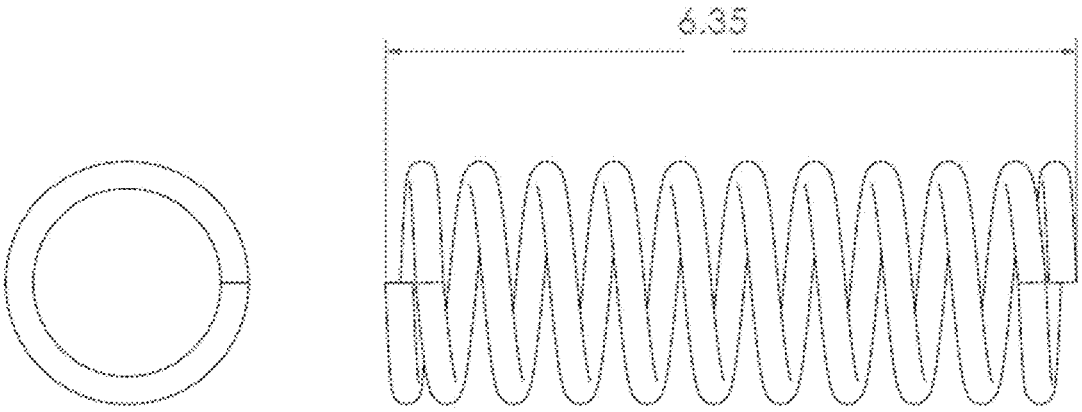

FIG. 3 shows the Biasing Spring. The Biasing Spring is housed within the Biasing Spring Housing on the Lever. The Biasing Spring is 0.25" in Length, with a wire diameter of 0.01". The spring rate is 4.33 lbs/in and the Material is Stainless Steel. It has an outer diameter of 0.088" and an inner diameter of 0.068".

The Biasing Spring (FIG. 3) biases the Tab away from the Lever (FIG. 1, FIG. 1.5). In the downward most position of both the Tab and the Lever, when the bolt of the firearm is in its rearward most position, and the Lever is being held down, the spring pushes the tab away from the lever such that the companion ledges on the tab and the lever decouple, and the Tab Spring (FIG. 5) can push the Tab upwards into the path of the bolt carrier group. This provides the disconnect functionality that prevents the user from defeating the BRS by holding down the arm of the Lever.

FIG. 4 shows the Lever Spring. The Lever Spring is attached to the spring post on the Lever (FIG. 1, FIG. 1.5). The Lever Spring is 0.375" in length, with a wire diameter of 0.016". The spring rate is 9.71 lbs/in and the material is stainless steel. It has an outer diameter of 0.12" and an inner diameter of 0.088".

The Lever Spring biases the Lever upwards such that it's ledge can couple with the companion ledge of the Tab in the upward most position. This coupling of the ledges allows the user to interface with the arm on the Lever (FIG. 1, FIG. 1.5) and pull both the Tab (FIG. 2) and the Lever (FIG. 1, FIG. 1.5) down, which releases the bolt and allows the next cartridge to be chambered.

FIG. 5 shows the Tab Spring. The Tab Spring is attached to the spring post on the Tab (FIG. 2). The Tab Spring is 0.5" in length, with a wire diameter of 0.016". The spring rate is 8.5 lbs/in and the material is stainless steel. It has an inner diameter of 0.12" and an outer diameter of 0.088".

The Tab Spring biases the Tab (FIG. 2) upwards into the path of the bolt carrier group such that upon every firing cycle, the Tab (FIG. 2) can prevent the bolt carrier group from chambering another cartridge.

Figure 6:
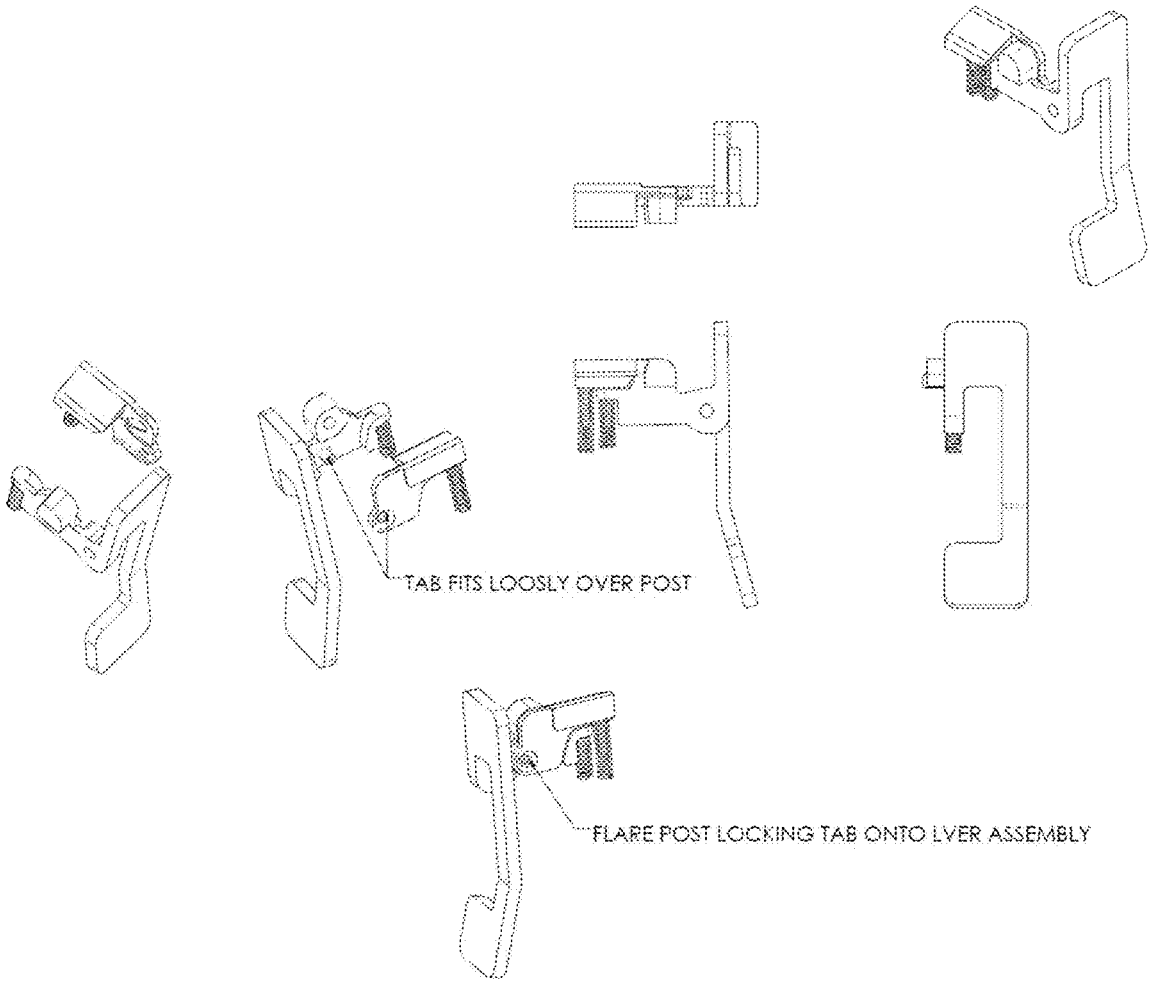

FIG. 6 shows a fully assembled BRS with the Lever (FIG. 1, FIG. 1.5) and the Tab (FIG. 2) attached to each other via the pivot post on the Lever (FIG. 1, FIG. 1.5). It also shows the Biasing Spring (FIG. 3) in its housing on the Lever (FIG. 1, FIG. 1.5), the Tab Spring (FIG. 5) on the spring post of the Tab (FIG. 2), and the Lever Spring (FIG. 4) on the spring post of the Lever (FIG. 1, FIG. 1.5).

Figure 7:
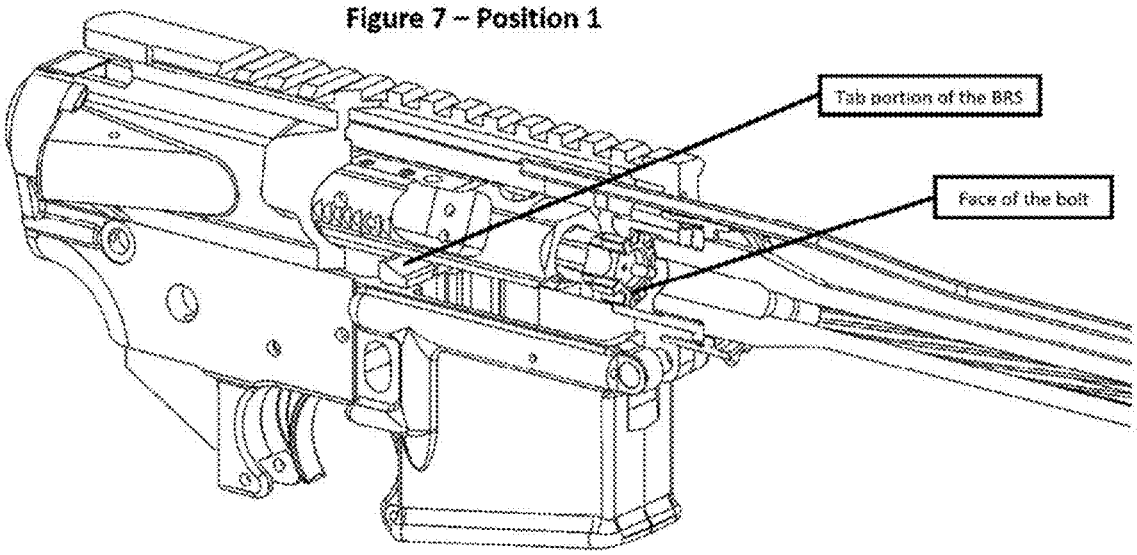

FIG. 7 shows the BRS in its starting position, Position 1. In this position, a cartridge has been chambered, the Bolt is in its forward most position, the Bolt carrier group is keeping the tab portion of the BRS down, and the firearm is ready to fire. Pulling the trigger advances the operation of the BRS to Position 2 (FIG. 8).

Figure 8:
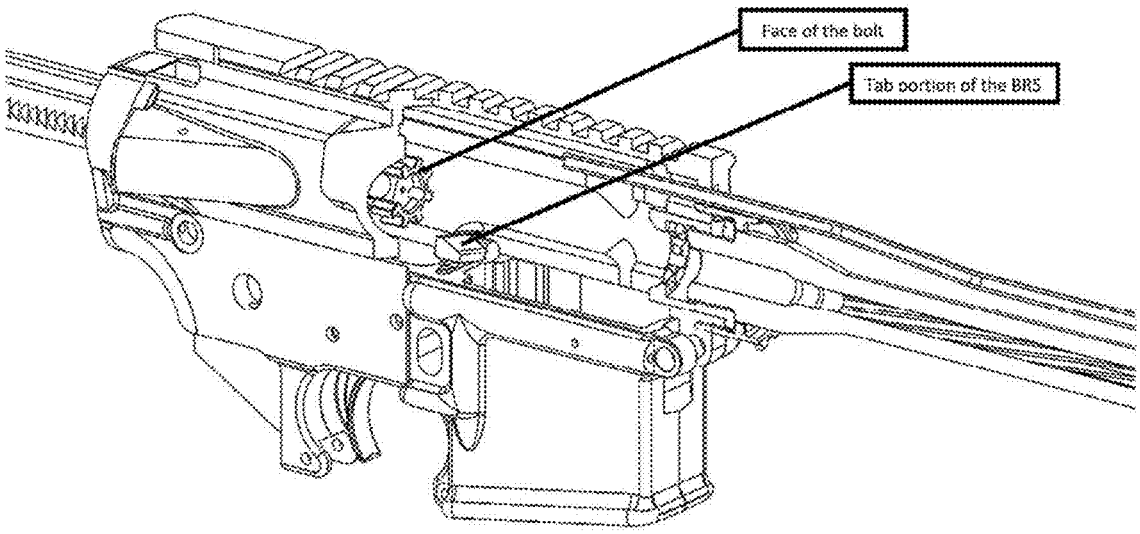

FIG. 8 shows the BRS in its second position, Position 2. In this position, a round has been fired, the bolt is sent to its rearward most position, and the Tab is allowed to be biased upwards by the biasing spring into the path of the bolt via the Tab Spring.

Figure 9:
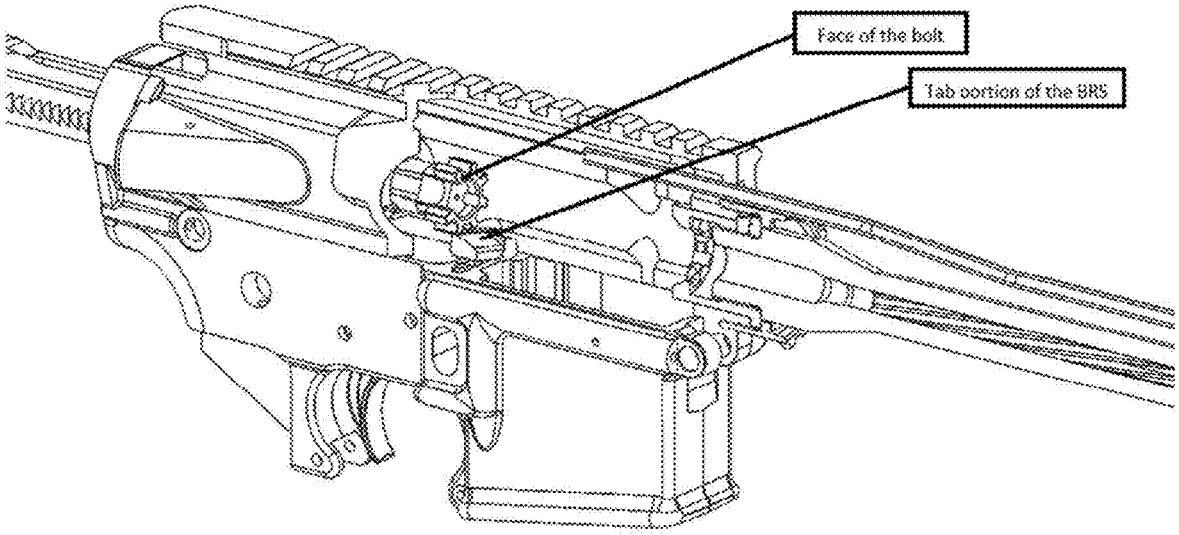

FIG. 9 shows the BRS in its third position, Position 3. In this position, the bolt has begun its path back to its starting position. Its forward motion is blocked by the Tab portion of the BRS.

FIG. 9 also shows the BRS in the position that illustrates the disconnect functionality. When a user attempts to defeat the BRS by holding down on the arm on the Lever (FIG. 1, FIG. 1.5), the two companion ledges on the Tab and the Lever separate, and the frictional force caused by the tilting of the tab keeps the Lever ledge from re-engaging with the Tab ledge. Because the ledges must be in contact for the user to be able to release the bolt, the firing cycle is paused until the user releases the pressure from the bolt which releases the frictional force keeping the lever down and the ledges from interacting. Once force has been released, the Lever rises up via the Lever Spring, the companion ledges mate, and the user can interact with the arm on the Lever to release the bolt.

Figure 10:
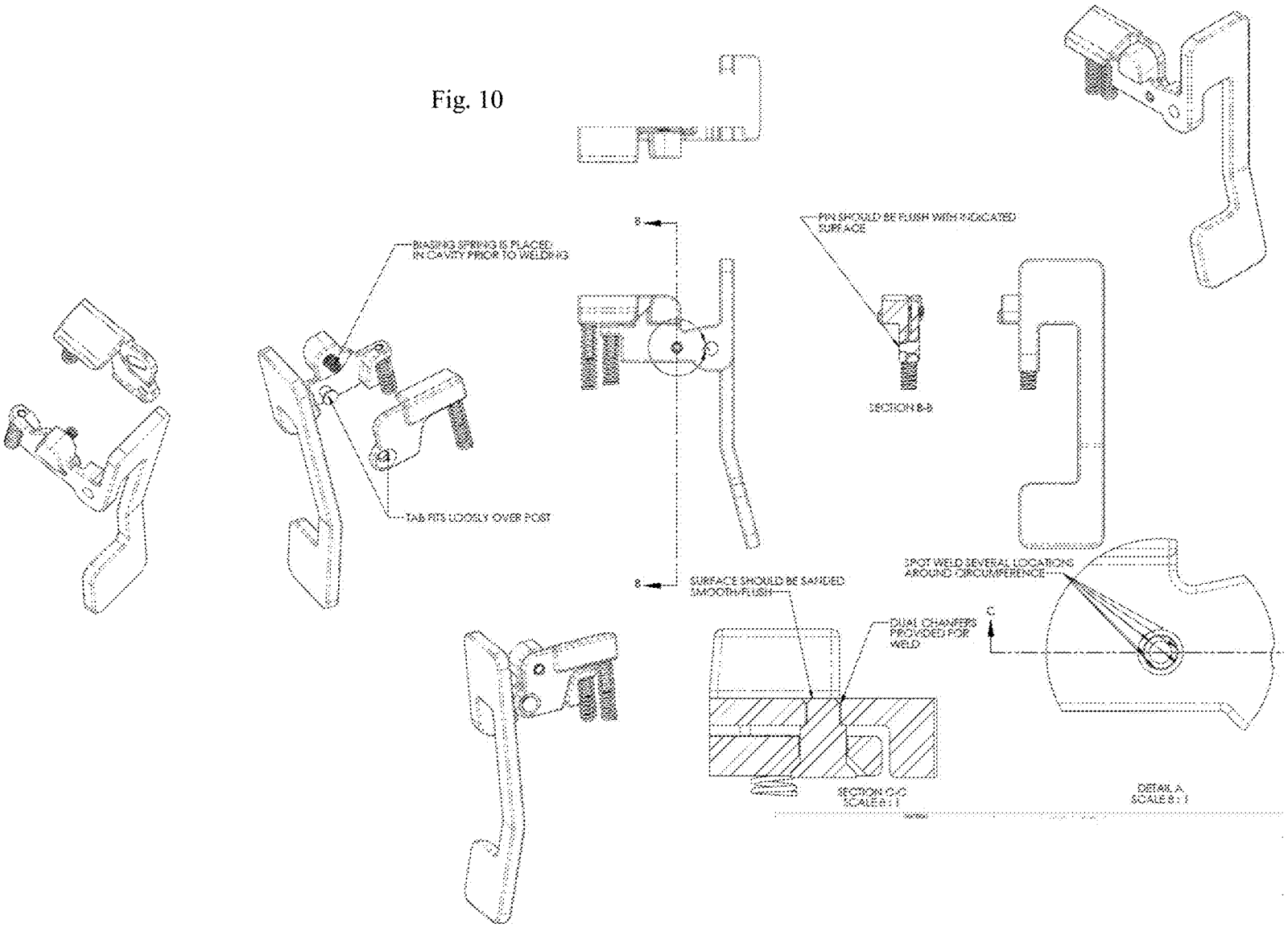

FIG. 10 shows various partial exploded of the Lever in two levels of detail.

Figure 11:
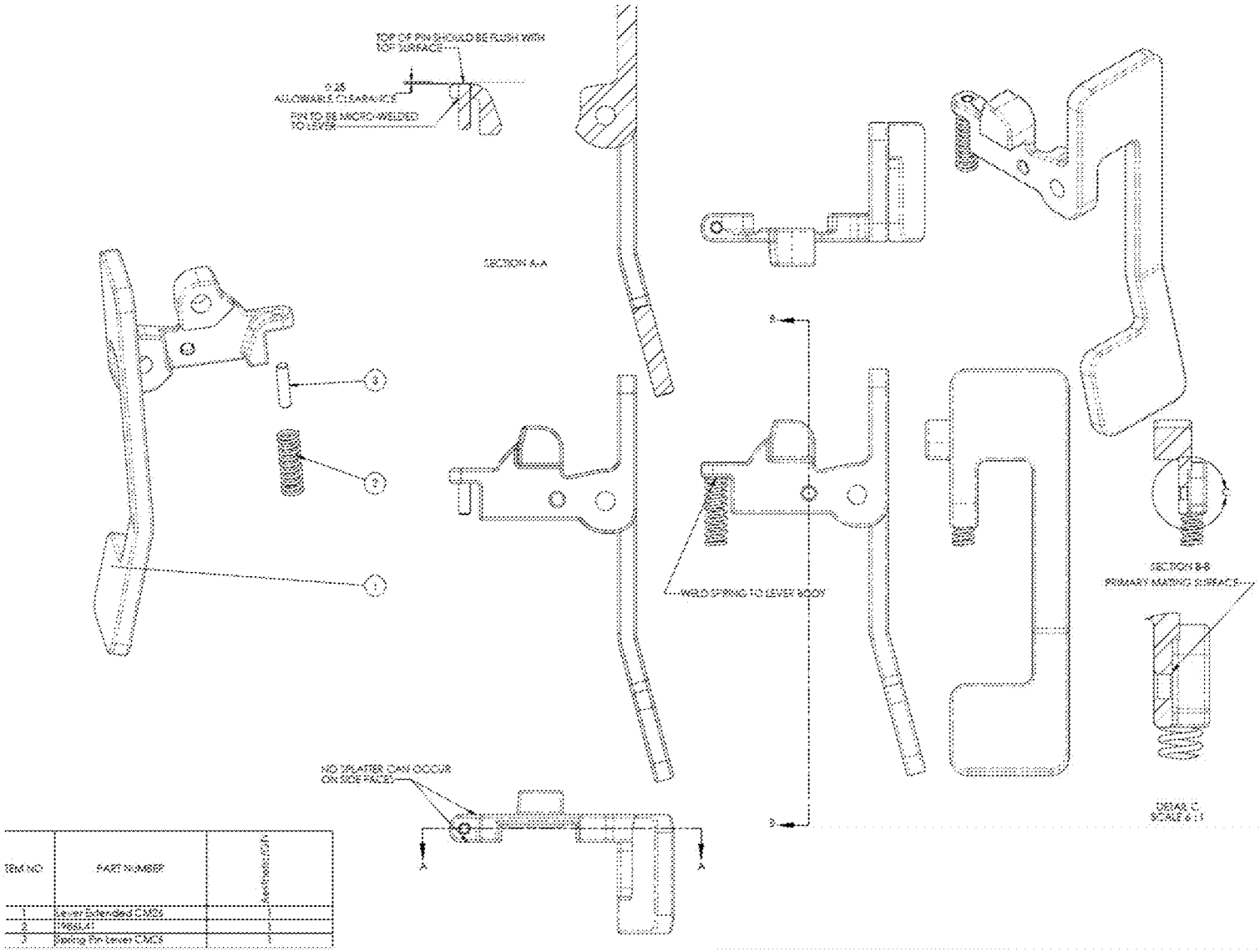

FIG. 11 shows various partial exploded views of the Lever in two levels of detail.

Figure 12:
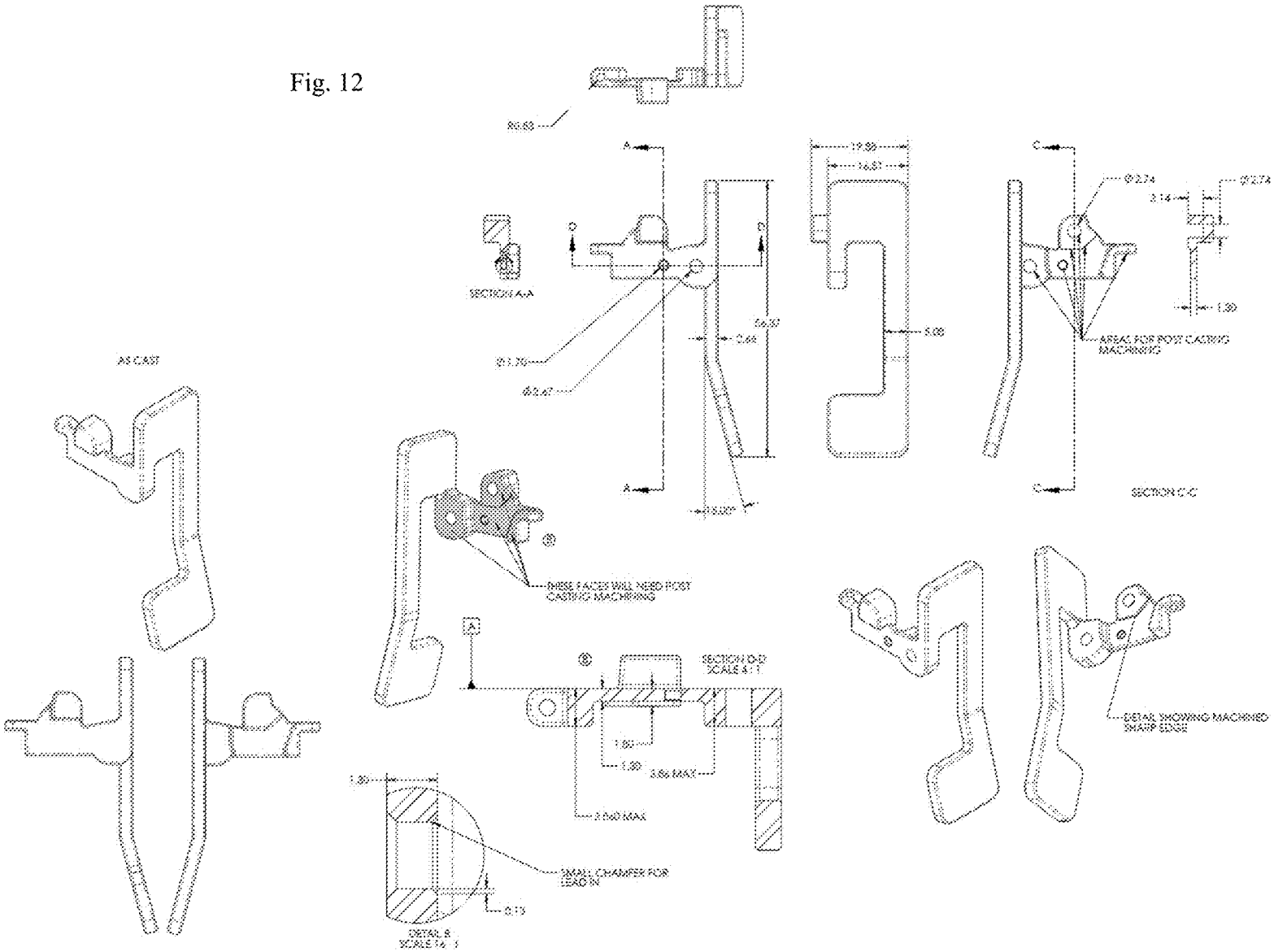

FIG. 12 shows various views of the Lever without the springs in two levels of detail.

Figure 13:
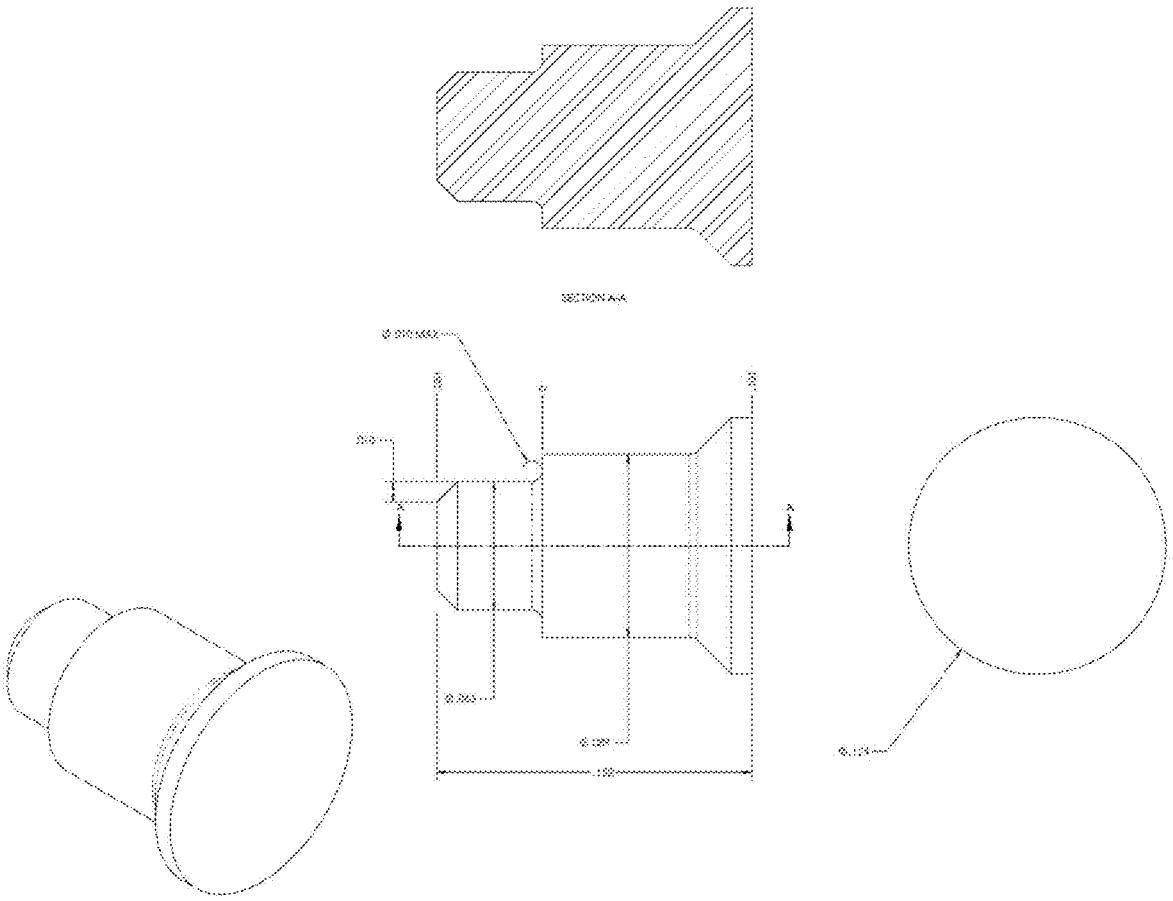

FIG. 13 shows a pivot pin.

Figure 14A:
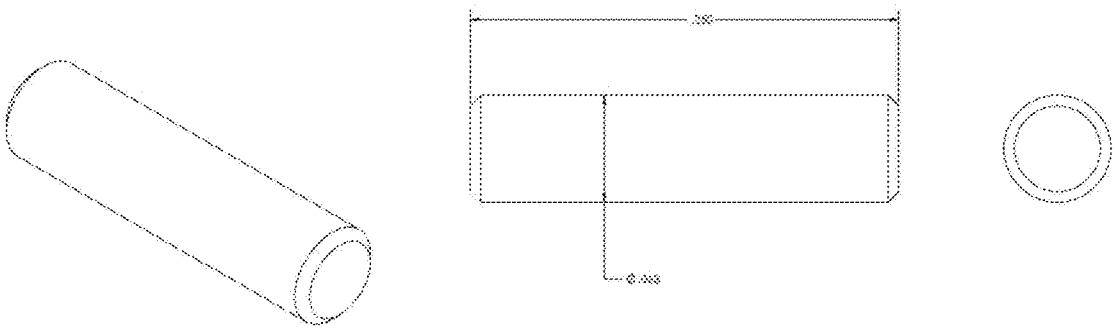

FIG. 14A shows a spring pin.

Figure 14B:
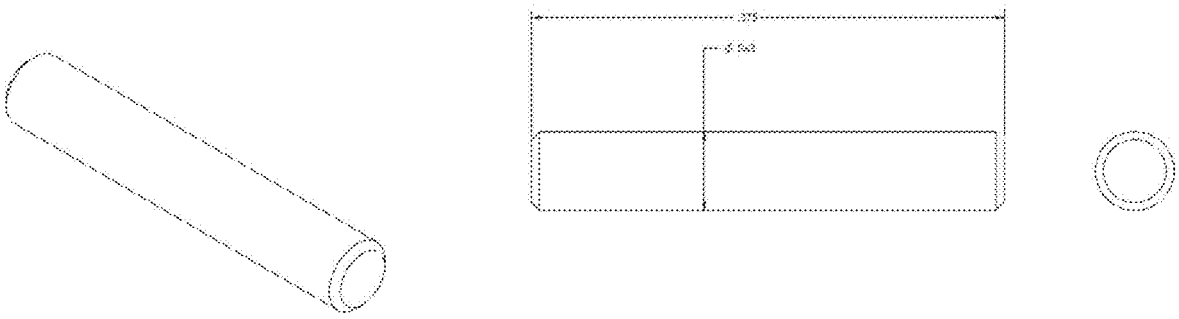

FIG. 14B shows a second spring pin.

Figure 15:
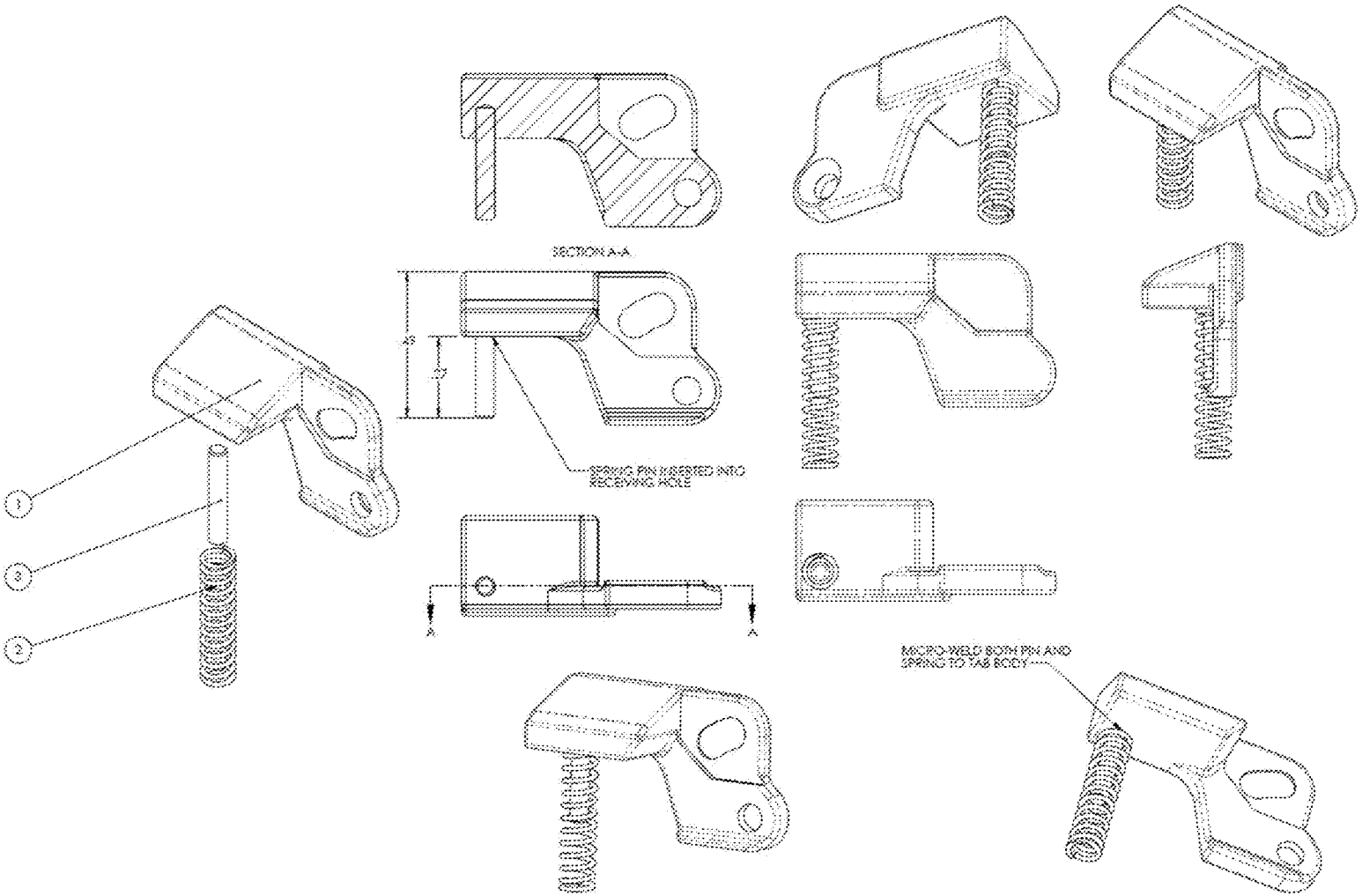

FIG. 15 shows a pivot pin.

Figure 16:
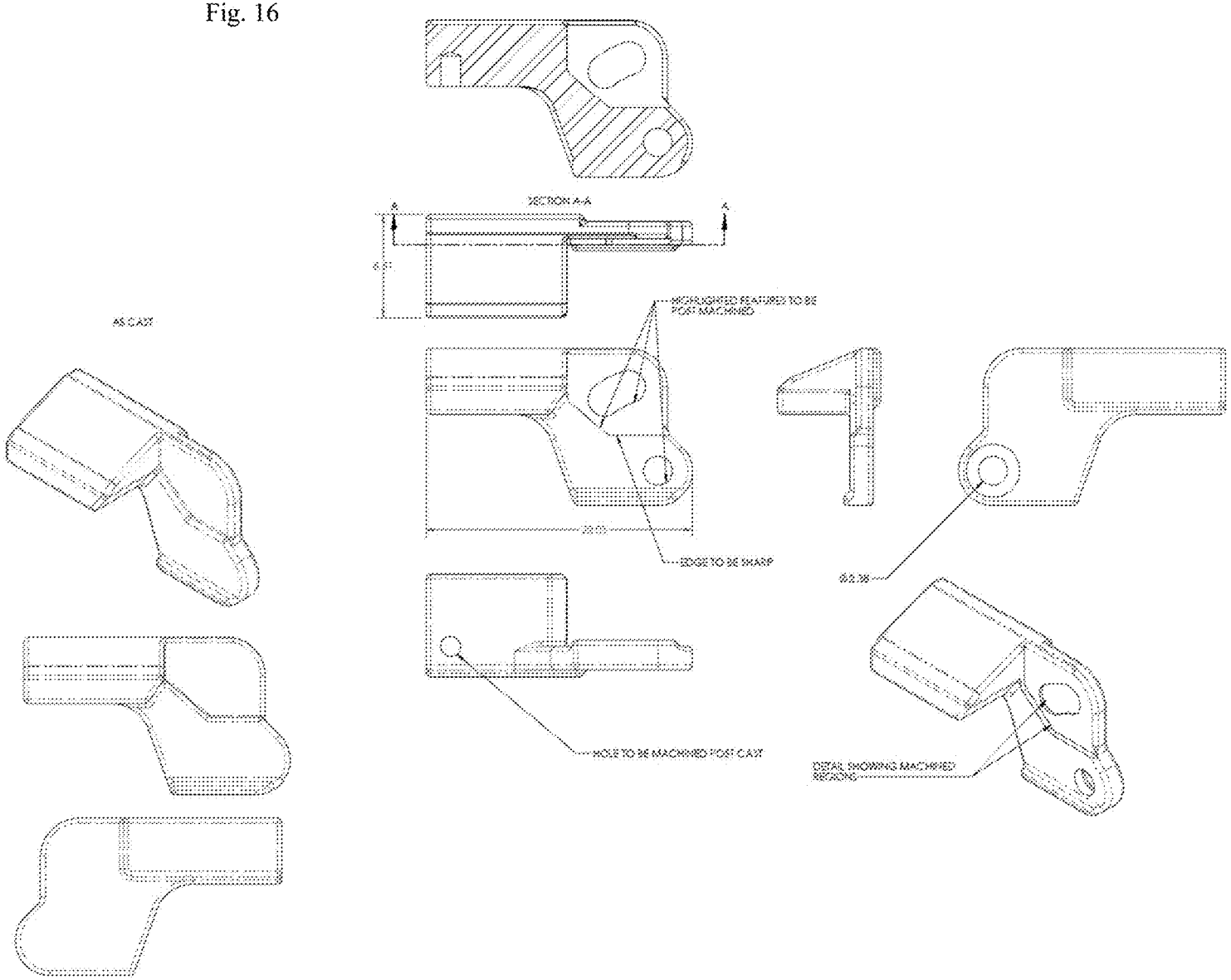

FIG. 16 shows various views of the tab body.

DETAILED DESCRIPTION OF A PREFERRED EMBODIMENT

The states that have "Assault Weapons Bans" often take a two-step approach to banning these rifles. First, they create a list of makes and models that are covered under the ban, and then they create a list of features that can be used to define "Assault Weapons". These features often include, but are not limited to:

- A semiautomatic, centerfire rifle that has the capacity to accept a detachable magazine and at least one of the following additional features:
  - (1) a pistol grip that protrudes conspicuously beneath the action of the weapon;
  - (2) a thumbhole stock;
  - (3) a folding or telescoping stock;
  - (4) a grenade or flare launcher;
  - (5) a flash suppressor; or
  - (6) a forward pistol grip;
- A semiautomatic, centerfire rifle that has a fixed magazine with the capacity to accept more than ten rounds;
- A semiautomatic, centerfire rifle that has an overall length of less than 30 inches;
- A semiautomatic pistol that has the capacity to accept a detachable magazine and any one of the following: 1) a threaded barrel, capable of accepting a flash suppressor, forward handgrip, or silencer; 2) a second handgrip; 3) a shroud that is attached to, or partially or completely encircles, the barrel allowing the bearer to fire the weapon without burning his or her hand, except a slide that encloses the barrel; or 4) the capacity to accept a detachable magazine at some location outside of the pistol grip;

A semiautomatic pistol with a fixed magazine that has the capacity to accept more than ten rounds;

A semiautomatic shotgun that has both a folding or telescoping stock, and a pistol grip that protrudes conspicuously beneath the action of the weapon, thumbhole stock, or vertical handgrip;

A semiautomatic shotgun that has the ability to accept a detachable magazine;

A shotgun with a revolving cylinder; or

A semiautomatic centerfire firearm that is not technically a rifle, pistol, or shotgun, if it either has a fixed magazine with the capacity to accept more than 10 rounds, has an overall length of less than 30 inches, or does not have a fixed magazine but has at least one of the features associated with assault weapons, as described above.

The Bolt Retention System (BRS) was designed to address such bans, and allow users to have banned features without being in violation of existing Assault Weapons bans. The BRS accomplishes this by converting a semiautomatic firearm into an interrupted-action firearm.

The BRS converts a semiautomatic firearm into an interrupted-action firearm by interrupting the semiautomatic firing cycle before a new cartridge is chambered and requires the user to manually load the new cartridge by interfacing with the BRS. It interrupts the firing cycle by physically stopping the bolt or breech face from chambering a cartridge. The BRS requires the user to act upon the interface in order to release the bolt or breech face, chamber the cartridge, and resume the firing cycle.

The BRS also prevents the user from defeating the device by way of a disconnector feature. Users cannot hold down the interface on the BRS to force semi-automatic functionality. An attempt to defeat the BRS causes the BRS to lock in place—at which point the user must release the pressure on the BRS from the bolt or breech face, and then interface with the BRS to release the bolt.

Where this operation meets the legal criteria, this change in the firearm's function prevents it from being able to be classified as an Assault Weapon.

I claim:

1. A firearm comprising:

a frame having a barrel and defining a passage registered with the barrel;

a bolt configured to reciprocate in the passage between a forward battery condition and a recoil condition;

a latch movable between a retention position in which the bolt is prevented by the latch from moving from the recoil position to the battery position, and a release condition in which the bolt is prevented by the latch from moving from the retracted position to the battery position;

the latch being biased to the retention position, such that the bolt is retained in the recoil position after every shot; and an actuator connected to the latch and movable between an inactive condition in which the latch is enabled for retention position, and an active condition, in which the latch is motivated to the release condition.

2. The firearm in claim 1 wherein the actuator and latch are operably interconnected between an engaged condition and a disengaged condition.

3. The firearm in claim 2 wherein the actuator and latch move with respect to each other between the engaged condition and the disengaged condition in a direction parallel to the barrel.

4. The firearm in claim 3 wherein the actuator and latch abut each other in the engaged condition and are separated from each other in the disengaged condition.

5. The firearm in claim 1 wherein the actuator and latch include a disconnector interface operable when the latch is maintained in the active condition upon a shot to return the latch to the retention position to prevent a subsequent shot without first returning the actuator to the inactive condition.

6. The firearm in claim 1 wherein the latch is operable to remain in the retention position in response to reciprocation of the bolt to the recoil condition from the battery condition, except upon cycling the latch from the inactive condition to the active condition.

7. The firearm in claim 1 wherein the actuator is pivotally connected to the frame to pivot on an actuator axis.

8. The firearm in claim 7 wherein the latch is pivotally connected to the actuator to pivot on a latch axis.

9. The firearm in claim 8 wherein the latch axis is parallel to the actuator axis.

10. The firearm in claim 1 wherein the actuator and latch and pivotally connected to each other about a latch pivot axis, and are axially movable toward and away from each other between an engaged condition in which positioning the latch in the active condition maintains the latch in the release condition, and a disengaged position in which positioning the latch in the active condition allows the latch to remain in the retention condition.

11. The firearm in claim 10 wherein the actuator and latch have respective ledge surfaces configured to each other when in the engaged condition, and separated from each other when in the disengaged condition.

12. The firearm in claim 11 wherein the ledge surfaces are perpendicular to the latch pivot axis.

* * * * *